United States Patent [19]

Jackson

[11] Patent Number: 4,829,882

[45] Date of Patent: May 16, 1989

[54] CRAWL SPACE VENTILATION SYSTEM

[76] Inventor: James S. Jackson, P.O. Box 1276, Chesapeake, Va. 23320

[21] Appl. No.: 140,067

[22] Filed: Dec. 31, 1987

[51] Int. Cl.[4] ..... F24F 7/007

[52] U.S. Cl. ..... 98/33.1; 236/49.1

[58] Field of Search ..... 98/1, 29, 33.1, 39.1, 98/40.18, 40.19, 42.02, 42.04; 236/49

[56] References Cited

U.S. PATENT DOCUMENTS

| | | | |
|---|---|---|---|
| 2,510,524 | 6/1950 | Schramm | 98/33.1 |
| 3,150,584 | 9/1964 | Allander | 98/33.1 |
| 3,221,632 | 12/1965 | Copp . | |
| 3,368,756 | 2/1968 | Edwards | 236/49 |
| 3,575,641 | 4/1971 | Long et al. | 317/153 |
| 3,974,754 | 8/1976 | Powlesland | 98/33.1 |
| 4,136,822 | 1/1979 | Felter | 98/42.04 X |
| 4,665,351 | 5/1987 | Nyberg | 318/483 |
| 4,669,371 | 6/1987 | Sarazen, Jr. et al. | 98/29 |
| 4,692,751 | 4/1987 | Upton et al. | 340/602 |
| 4,702,149 | 10/1987 | Speer | 98/37 |

FOREIGN PATENT DOCUMENTS

| | | | |
|---|---|---|---|
| 545591 | 10/1922 | France | 98/33.1 |
| 121335 | 9/1980 | Japan | 98/31.5 |
| 53331 | 5/1981 | Japan | 98/42.04 |
| 52231 | 7/1910 | Switzerland | 98/33.1 |
| 2115922 | 9/1983 | United Kingdom | 98/42.04 |

*Primary Examiner*—Harold Joyce

*Attorney, Agent, or Firm*—Griffin, Branigan & Butler

[57] ABSTRACT

A crawl space ventilation system includes an intake fan assemby (10) having a housing with an 8×15 inch tubular mounting portion (b 16), a jet-stream directing portion (30) which is substantially smaller than the mounting portion, and an electric fan mounted in the housing for driving air toward the jet-stream directing portion. The mounting portion is mounted in a crawl-space vent hole with the jet portion directed into the crawl-space toward a particular area to be ventilated. The crawl-space ventilation system also includes an outlet fan assembly (44) with an approximately 8×15 inch housing (46) and a jet-catching end (51). The outlet fan assembly also is mounted in a crawl space vent and is positioned to capture the air jet driven into the crawl space by the inlet fan assembly. Intermediate booster fan assemblies (70, 72) are also included to be mounted in the crawl space between vents for capturing and transmitting the jet stream between the inlet and outlet fan assemblies. Humidistats control the various fan assemblies.

13 Claims, 3 Drawing Sheets

CRAWL SPACE VENTILATION SYSTEM

BACKGROUND OF THE INVENTION

This invention relates generally to ventilation systems for crawl spaces under houses and more specifically to such ventilation systems for preventing rot and corrosion due to moisture.

Many house, especially those in areas with high water tables, are built with crawl spaces thereunder. Nicer homes, such as brick homes, as well as other homes, often have walls extending to the ground around the crawl spaces for aesthetic purposes. A difficulty with crawl spaces which are thusly walled in is that they create a stagnant environment therein which is often filled with moist air. This moist air tends to cause mold, mildew, rot and general corrosion under a house. To avoid such corrosion most builders install 8×15 inch side vents in the house walls about the crawl spaces. These vents allow air to pass through the crawl spaces, thereby reducing the stagnation therein, and periodically flushing out moist air. However, such vents tend to create air flows along certain lines only, still leaving pockets of stagnant, moist, air where rotting and corrosion takes place. It is an object of this invention to provide a crawl-space ventilation system which does not leave undesirable pockets of stagnant air in that it allows one to target such pockets for eradication.

It is a further object of this invention to provide a ventilation system for a house crawl space which can be relatively easily installed without damaging or changing the house.

Further still, it is an object of this invention to provide such a ventilation system which is relatively inexpensive to manufacture, install and operate, but yet is extremely effective in eliminating rotting in the crawl space of a house.

SUMMARY

According to principles of this invention, a house crawl space ventilation system includes an inlet fan assembly having a tubular housing with an 8×15 inch mounting portion and a jet-creating portion with an electric fan mounted therein. The inlet fan assembly is mounted in an 8×15 inch ventilation hole of a house crawl space with the jet portion pointing into the crawl space and directing an air jet toward a stagnant space therein to ventilate the space. The ventilation system also includes an outlet fan assembly having a tubular housing with an 8×15 inch housing and a jet-catching end with an electric fan therein for receiving the jet ventilation stream created by the inlet fan assembly and exhausting it from the crawl space. The ventilation system also includes intermediate booster fan assemblies having tubular housings with jet catching ends and jet-creating ends for being positioned intermediate the inlet and outlet fan assemblies. A system of humidistats located at stagnant areas to be ventilated controls power to the fan assemblies simultaneously.

BRIEF DESCRIPTION OF THE DRAWING

The foregoing and other objects, features and advantages of the invention will be apparent from the following more particular description of a preferred embodiment of the invention, as illustrated in the accompanying drawings in which reference characters refer to the same parts throughout the different views The drawings are not necessarily to scale, emphasis instead being placed upon illustrating principles of the invention in a clear manner.

DESCRIPTION OF THE PREFERRED EMBODIMENT

Figure 1:
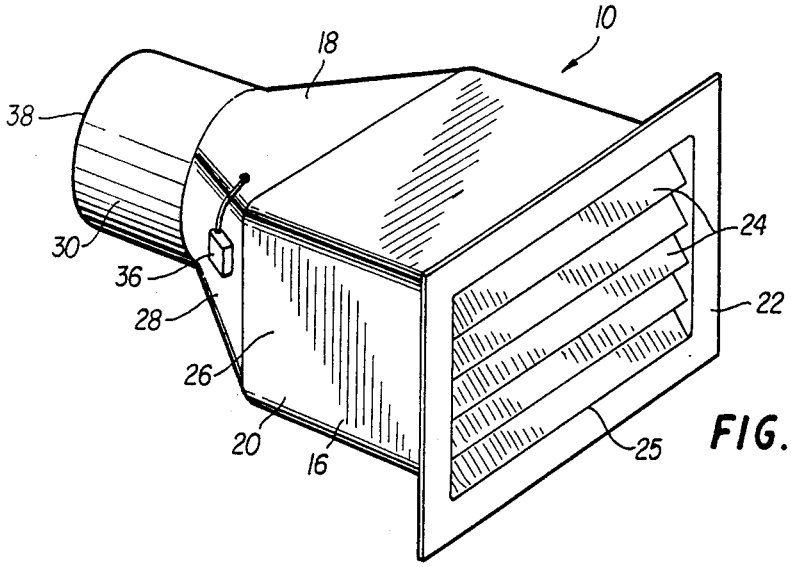
FIG. 1 is an isometric view of an inlet fan assembly of the crawl-space ventilation system of this invention.
Figure 3:
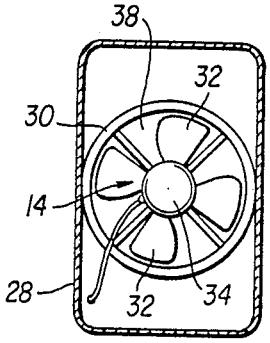
FIG. 3 is a cross-sectional view taken on line 3—3 in FIG. 2.
Figure 4:
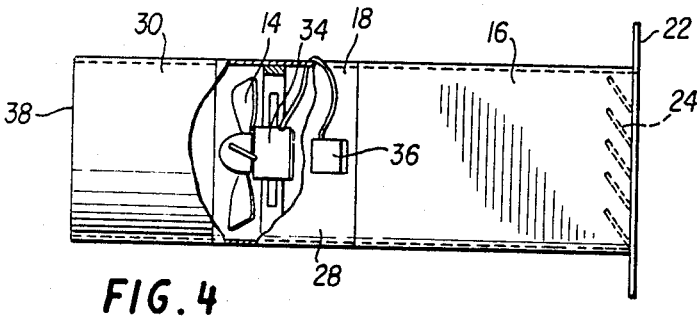
FIG. 4 is a side, partially cutaway, view of the inlet fan assembly of FIG. 1.
Figure 6:
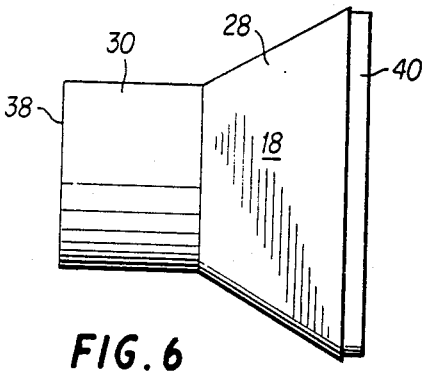
FIG. 6 is a top view of a jet-creating portion of the fan assembly of FIG. 2.
Figure 7:
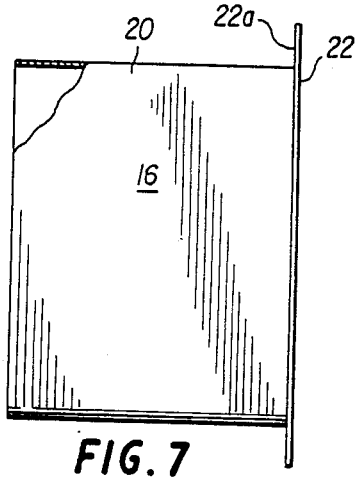
FIG. 7 is a top view of a mounting portion of the fan assembly of FIG. 1.

An inlet fan assembly 10 for a crawl space jet ventilation system of this invention, as shown in FIG. 1, comprises a housing 12 and an electric motor driven fan 14 (FIGS. 3 and 4). The housing 12 comprises a vent-mounting portion 16 and a jet-creating portion 18, and each of these elements is respectively depicted separately in FIGS. 6 and 7. The housing-mounting portion 16 comprises mainly an 8×15 inch rectangular tube 20 with a flange 22 and louver slats 24 mounted at an outer mouth 25 thereof. The rectangular tube 20 can be constructed of metal, however, in the preferred embodiment, it is constructed of a hard, flame resistant, plastic. The flange 22 extends outwardly from an outer surface 26 of the rectangular tube 20 and its rear surface **22*a* is designed to abut against the front surface of a house when the housing mounting portion 16 is mounted in a crawl space vent opening. The louver slats 24 are hung on pivots located at opposite ends thereof near the top edges so that an inward air flow from outside atmosphere into the rectangular tube 20** through the louver slats tends to open them automatically, but when there is no wind their weight closes them.

The jet-creating portion 18 comprises an inwardly tapered portion 28 and a jet-stream directing portion 30. The inwardly tapered portion 28, as can be seen by comparing FIGS. 2 and 4 tapers inwardly at the sides, but the height dimension, between the top and bottom, remains a constant 8 inches. Again, the jet-creating portion can be made of a metal or a hard, flame-resistant, plastic.

The electric fan 14 is mounted in the round jet-stream directing portion 30 of the housing 12. In this respect, the jet-stream directing portion 30 has a diameter of 8 inches and blades 32 of the electric fan 14 extend from a motor 34 almost to the wall of the jet-stream directing portion 30. When the fan 14 is energized via a switch 36 it rotates in a direction to suck air through the louvers, thereby opening the louvers, and to drive this air out of an end 38 of the jet-stream directing portion 30.

In the preferred embodiment, the jet-creating portion 18 with its inwardly tapered portion 28 and its jet-stream directing portion 30 is separate from the housing-mounting portion 16, these elements being fitted together by a female tab 40 (FIG. 6) on the jet-creating portion 18. Although the female tab 40 maybe held to the rectangular tube 20 by means of friction between an inner surface of the rectangular tube 20 and an outer surface of the female tab 40, if necessary, fasteners, such as screws, could be driven between these two members to ensure that they stay together.

Figure 2:
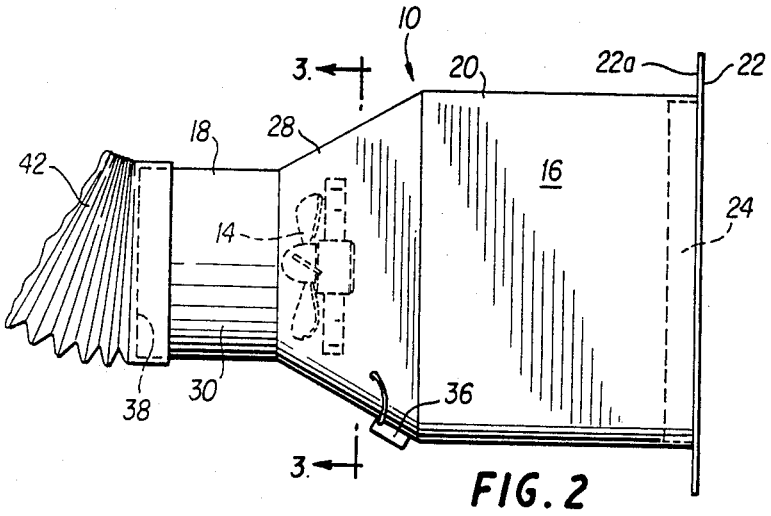
FIG. 2 is a top view of the inlet fan assembly of FIG. 1 with an additional aiming member mounted thereon.

In FIG. 2 is shown an adjunct jet-stream directing, or aiming, member 42 which can be manually maneuvered to direct a stream of air exiting from the end 38 of the jet-stream directing portion 30 in a particular direction. In this regard, the jet-stream aiming member 42 is a corrugated tube of a type used for clothes dryers and the like which can be snapped into any desired position for directing air in a desired direction.

Figure 9:
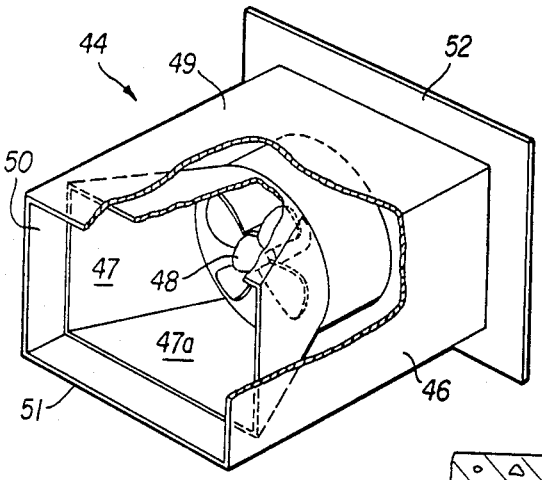
FIG. 9 is an isometric, partially-cutaway, view of an exhaust-fan assembly of the ventilation system of FIG. 8.
Figure 11:
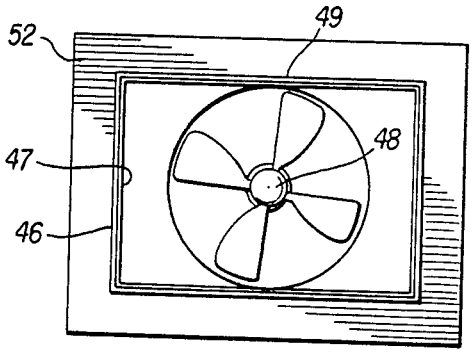
FIG. 11 is an inner-end view of the exhaust fan assembly of FIGS. 9 and 10.
Figure 10:
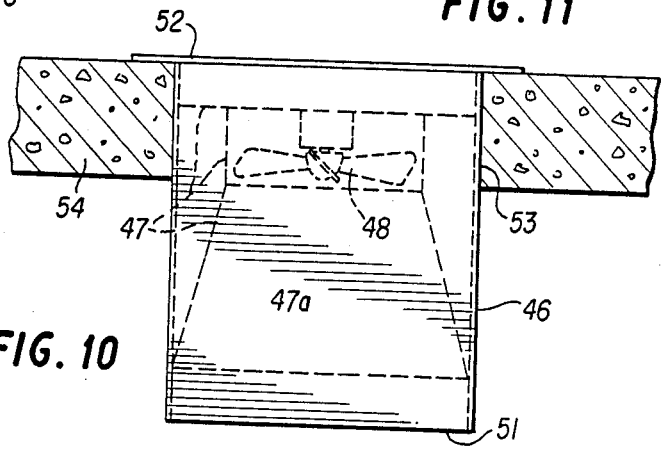
FIG. 10 is a top, partially-segmented, view of the exhaust-fan assembly of FIG. 9 mounted in a crawl space ventilation hole.

Looking next at an outlet exhaust fan assembly 44 of this invention which is depicted in FIG. 9, this assembly includes a housing 46 having baffles 47 and an electric fan 38 mounted therein. The housing 46 has an approximately 8×15 inch rectangular outer surface 49 and a flange 52 at an outer end thereof directed away from the outer surface 49 of the housing 46. A jet-catching end portion 50 includes baffles **47*a* which guide air entering the jet-catching end 51 to the fan 48. The fan 48 has a diameter of almost 8 inches. The housing 46 is approximately 12 inches long. The outlet exhaust fan assembly 44 is mounted in a standard crawl-space 8×15 inch vent 53 by inserting it therein through the vent from the outside of a house 54 until the flange 52 contacts the outer surface of the house 54. The flange 52** can be positively attached to the house to hold it in the vent hole.

Figure 8:
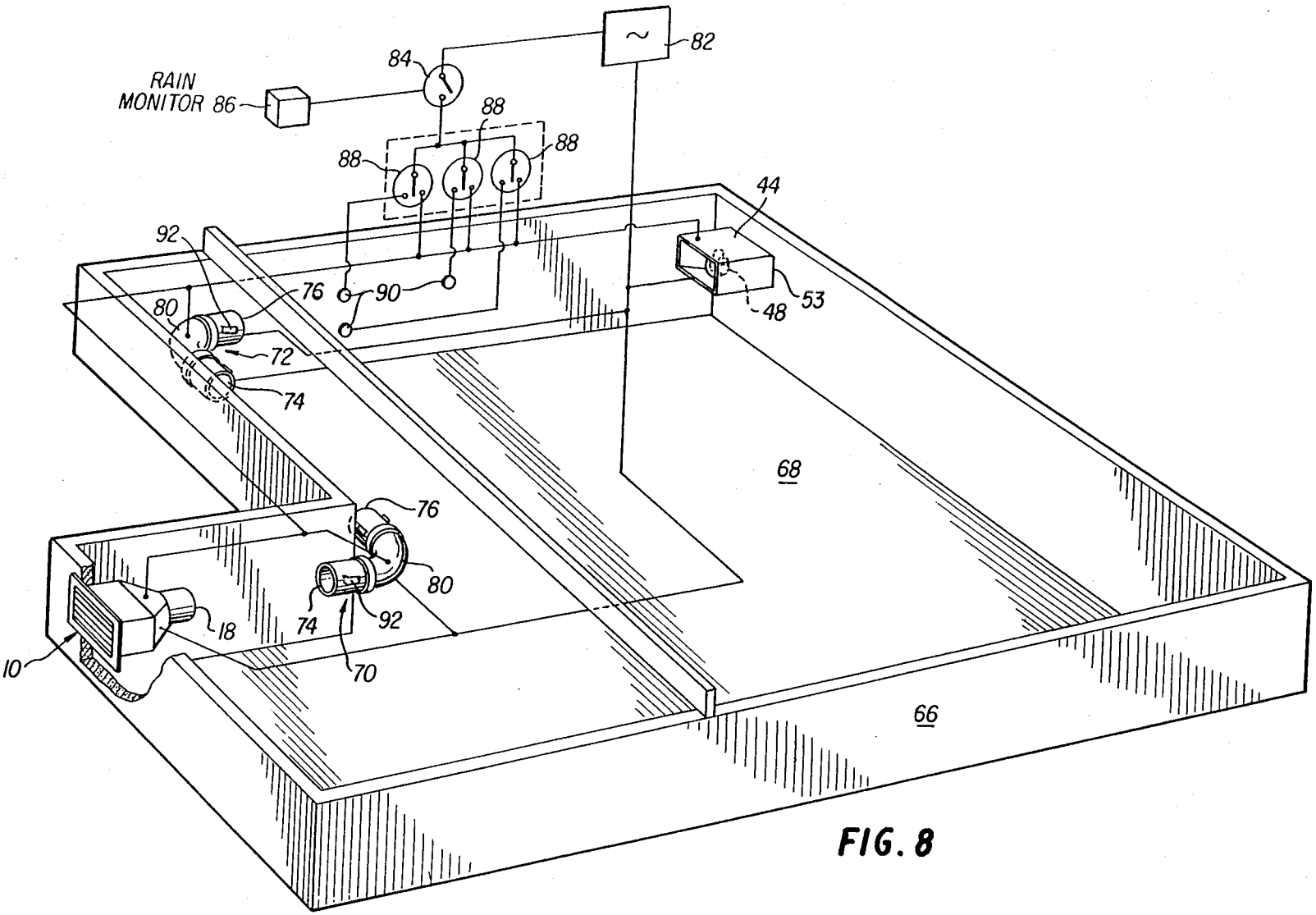
FIG. 8 is an isometric, and partially schematic, view of a crawl space having a crawl-space jet ventilation system of this invention mounted therein.

FIG. 8 depicts an overall crawl-space jet-ventilation system of this invention in which are shown an inlet fan assembly 10 and an outlet exhaust fan assembly 44, both mounted in 8×15 inch vents 53 defined by house walls 66 enclosing a crawl space 68. Also disclosed in FIG. 8 are intermediate booster fan assemblies 70 and 72, each of which includes an 8 inch diameter tube having a jet catching end 74 and a jet exhausting end 76. Electric fans 78 (FIG. 12) in the intermediate fan assemblies 70 and 72 catch the ventilation jet streams from upstream fan assemblies and drive them through the 8 inch exhausting ends 76. The jet-exhausting ends 76 blow these jet-streams to the next fan assemblies.

Also depicted schematically in FIG. 8 is an electrical energizing circuit which includes an energy source 82 (house current), a rain switch 84 controlled by a rain monitor 86, and humidity switches 88 controlled by humidistats 90.

The rain switch 84 and the humidity switches 88 are connected in series between the energy source 82 and the fan assemblies while the humidity switches 88 and the fan assemblies are connected in parallel with each other. In this respect, the rain switch 84 provides power to the upstream sides of all of the humidity switches 88 and all of the downstream ends of the humidity switches 88 are connected to all of the fan assemblies, 10, 44, 70, and 72. Thus, when the rain switch 84 is opened, the system is deactivated and cannot be activated by the humidity switches 88. However, when the rain switch 84 is in a closed position, any one of the humidity switches 88 can operate all of the fan assemblies 10, 44, 70 and 72 simultaneously. The rain switch 84 is automatically placed in a closed position when the monitor 86, which is positioned outside house wall 66, determines that it is not raining and is automatically placed in an open position when the rain monitor 86 determines that it is raining. Humidity switches 88 are each automatically placed in an open position when its corresponding humidistat 90 detects humidity below a set level and in a closed position when the humidity is above a set level.

Figure 12:
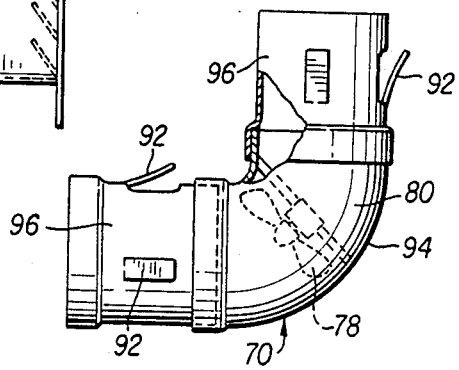
FIG. 12 is a top view of an intermediate-fan assembly of this invention.
Figure 5:
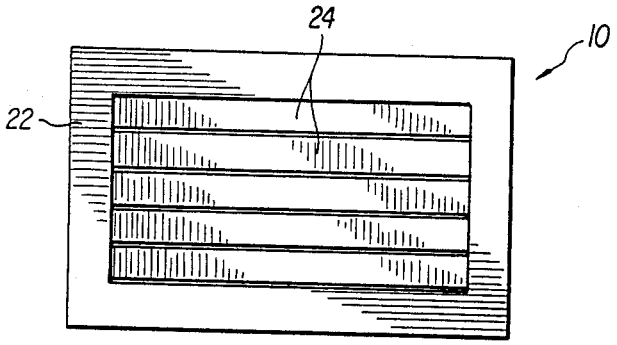
FIG. 5 is a front view of the inlet fan assembly of FIG. 1.

FIG. 12 depicts the intermediate fan assembly 70 in more detail, showing that the fan 80 is mounted in an elbow portion 94 thereof. Straight portions 96 can be selectively coupled to the elbow portion 94 and to each other, by interlocking the ends together. With such a construction the intermediate fan assemblies 70, 72 and others can be assembled to be various shapes and lengths.

Describing now operation of the crawl-space jet-ventilation system of this invention, before the system is installed it is determined where in a crawl space stagnant air pockets exist. This can be determined by moisture meters or, over a period of time, by watching the deterioration of wood located in the crawl space. In areas where wood appears to be corroding or rotting, one ca assume the air is stagnant and that its humidity is too high. Further, those with experience in ventilating crawl spaces can estimate where stagnant-air locations are. Thereafter, vent holes in the house wall 66 are chosen for mounting the inlet fan assembly 10 and the outlet exhaust fan assembly 44 for creating a jet of air passing through the stagnant air locations. In this regard, it might be possible to locate the inlet fan assembly 10 directly across from the outlet fan assembly 44 so that the jet-creating portion 18 of the inlet fan assembly 10 blows a jet-stream directly into the jet-catching ends 51 of the outlet exhaust fan assembly 44. When this is possible, no intermediated booster fan assemblies are required. However, it might also be necessary to use intermediate fan assemblies 70 and 72 for catching the jet-stream exhausting from the jet-creating portion 18 of the inlet fan assembly 10 with the jet-catching end 74 of the intermediate fan assembly 70 and further directing it into the intermediate fan assembly 72. The intermediate fan assembly 72 boosts and refocuses the jet-stream and directs it into the jet-catching end 51 of the outlet exhaust fan assembly 44. This system is designed so that the rotting, or stagnant-air, areas are located between the jet-creating portions and the jet-catching portions of the fan assemblies so that a jet of air which is directed from outside the house wall 66 passes therethrough or near thereto. If it is necessary to locate a fan assembly 10, 44, 70 and/or 72 at a stagnant air area, it is also possible to place a cutout with a baffle 92 in the wall of the intermediate fan assembly for diverting a small amount of fresh jet-air to the rotting area.

The humidistats 90 are placed at the stagnant air, or rotting, areas so that when the humidity in one of these areas rises above a certain amount, a humidity switch 88 is closed, thereby activating fans in all the fan assemblies to create the jets for ventilating the stagnant air areas as described above. However, when it is raining and the humidity rises above the certain amount, although the humidity switches 88 will close, they will not operate the fans because the rain switch 84 will be open. This prevents the system from sucking rain into the crawl space.

It can be appreciated by those skilled in the art that the crawl-space jet-ventilation system described herein can be used for particularly targeting hard to ventilate stagnant areas of crawl spaces. The system can be easily mounted in existing crawl spaces with existing vent holes without changing the house in which they are mounted.

While the invention has been particularly shown and described with reference to a preferred embodiment, it will be understood by those skilled in the art that various changes in form and detail may be made therein without departing from the spirit and scope of the invention. For example, the jet-stream aiming member 42 could be used for aiming the initial jet-stream coming into a house crawl space in a particular direction. Other mechanisms could also be used as aiming devices. Further, the system could be used without the intermediate or outlet exhaust fan assemblies where it is not necessary to retain a jet-stream composed of air coming from outside the house for long distances and around turns. It is possible to construct the fan assemblies with structures other than those depicted herein.

The embodiments of the invention in which an exclusive property or privilege are claimed are defined as follows:

1. A house crawl space jet-ventilation system for use with a house crawl space having an inlet vent opening and an outlet vent opening, said system comprising:

an inlet fan assembly including an elongated tubular housing, said housing including a vent-mounting portion for fitting into said inlet vent opening, and a jet-creating portion located downstream of said vent-mounting portion, said jet-creating portion having a cross sectional size that is substantially smaller than the cross-sectional size of said vent-mounting portion, said inlet fan assembly further including an electrical, motor-driven, fan mounted in said elongated tubular housing for moving air through said elongated tubular housing from said vent-mounting portion to said jet-creating portion for directing a jet stream of air from outside said crawl space to open air inside said crawl space in a first direction;

an outlet fan assembly for being located at said outlet vent opening to suck air out of said crawl space, said outlet fan assembly including an elongated tubular housing having a vent-mounting portion for fitting into said outlet vent opening, and a tubular jet-catching portion located upstream of said vent-mounting portion, said outlet fan assembly further including an electrical, motor-driven, fan mounted in said elongated tubular housing for moving air through said elongated tubular housing from said jet catching portion to said jet mounting portion for sucking said jet stream of air from open air inside said crawl space to outside said crawl space;

an intermediate fan assembly having a tubular housing with an electrical fan mounted therein for driving air through said tubular housing, said tubular housing including a curved portion and having an open jet-catching end and an open jet-creating end for being mounted in said open air of said crawl space intermediate, but spaced from, said inlet and outlet fan assemblies with said jet catching end being directed for catching said jet stream of air coming from said inlet fan assembly and said jet creating end being directed in another direction than said first direction of said jet stream of air for relying said jet stream of air along a curved path to said jet catching portion of said outlet fan assembly;

whereby said inlet fan assembly can be mounted in said inlet vent opening with said jet-creating portion being inside the crawl space of the house to direct said jet-stream of air from outside the house into the crawl space, said outlet fan assembly can be mounted in said outlet vent opening with said jet-catching portion being inside the crawl space to catch said jet stream of air in said crawl space, and said intermediate fan assembly can be positioned inside said crawl space with its jet catching portion catching said jet stream of air coming from said inlet fan assembly and its jet creating end moving said jet stream of air to said jet catching portion of said outlet fan assembly, said jet stream of air passing through the open air of said crawl space between said inlet and intermediate fan assemblies and between said intermediate and said outlet fan assemblies providing ventilation for selected areas of crawl space, said curved tubular housing of said intermediate fan assembly allowing the curving of said jet stream of air to said selected areas.

2. A house crawl space jet-ventilation system as in claim 1, wherein is further included a humidistat mountable in said selected areas of said crawl space for simultaneously controlling operations of said electric fans in each of said fan assemblies.

3. A house crawl space jet-ventilation system as in claim 2, wherein is further included a rain monitor to be located outside said crawl space for preventing operations of said electric fans when it rains.

4. A house crawl space jet-ventilation system as in claim 1, wherein is further included a rain monitor to be located outside said crawl space for preventing operations of said electric fans when it rains.

5. A house crawl space jet-ventilation system as in claim 1, wherein are included a plurality of intermediate fan assemblies spaced from one another for relaying said jet stream of air from said inlet fan assembly to said outlet fan assembly.

6. A house crawl space jet-ventilation system as in claim 1, wherein the vent mounting portions of said inlet and outlet fan assemblies are rectangularly shaped having a size of approximately $8 \times 15$ inches.

7. A house crawl space jet-ventilation system as in claim 1 wherein said tubular housing of said intermediate fan assembly includes a baffle for diverting a small amount of air from said jet stream lateral to said tubular housing of said intermediate fan assembly to a specific location in said crawl space.

8. A method of ventilating a crawl space including the steps of:

mounting an inlet fan assembly in a crawl space inlet vent opening with a fan therein for directing a jet stream of air from outside a crawl space into the crawl space, said inlet fan assembly including an elongated tubular housing, said housing including a vent-mounting portion for fitting into said inlet vent opening, and a jet creating portion located downstream of said vent-mounting portion, said jet-creating portion having a cross sectional size that is substantially smaller than the cross sectional size of said vent-mounting portion, said inlet fan assembly further including an electrical, motor-driven, fan mounted in said elongated tubular housing for moving air through said elongated tubular housing from said vent-mounting portion to said jet-creating portion for directing said jet stream of air from outside said crawl space to open air inside said crawl space in a first direction;

mounting an outlet fan assembly at an outlet crawl space vent opening for sucking air out of said crawl space, said outlet fan assembly including an elongated tubular housing having a vent mounting portion for fitting into said outlet vent opening, and a tubular jet catching portion located upstream of said vent-mounting portion, said outlet fan assembly further including an electrical, motor-driven, fan mounted in said elongated tubular housing for moving air through said elongated tubular housing from said catching portion to said vent mounting portion for sucking said jet stream of air from open air inside said crawl space to outside said crawl space;

mounting an intermediate fan assembly in a selected position in said crawl space intermediate said inlet and outlet fan assemblies for relaying said jet stream from said inlet fan assembly to said outlet fan assembly, said intermediate fan assembly having a tubular housing with an electrical fan mounted therein for driving air through said tubular housing, said tubular housing including a curved portion and having an open jet-catching end and an open jet-creating end for being mounted in said open air of said crawl space intermediate, but spaced from, said inlet and outlet fan assemblies with said jet catching end being directed for catching said jet stream of air coming from said inlet fan assembly and said jet creating end directed in another direction then said first direction of said jet stream of air for relying said jet stream of air along a curved path to said jet catching portion of said outlet fan assembly;

whereby driving said fans in said inlet, intermediate, and outlet fan assemblies creates a crawl space jet stream which, between said fan assemblies, is open to surrounding air in said crawl space, thereby providing ventilation for selected area of said crawl space, said curved tubular housing of said intermediate fan assembly allowing the curving of said jet stream of air to selected areas.

9. A method as in claim 8, wherein is further included the step of controlling operation of said fans with a humidistat which is mounted in said crawl space at one of said selected areas to be ventilated.

10. A method as in claim 9, wherein the step of employing a rain monitor located outside said crawl space for preventing operation of said electrical fans when it rains is also included.

11. A method as in claim 8, wherein the step of employing a rain monitor located outside said crawl space for preventing operation of said electrical fans when it rains is also included.

12. A method as in claim 8, wherein is further included the step of installing additional intermediate fan assemblies for relaying the crawl space jet stream of air between said inlet and outlet fan assemblies.

13. A method as in claim 8, wherein the step of mounting inlet and outlet fan assemblies includes the substeps of choosing fan assemblies having vent-mounting portions with rectangular shapes of a $8 \times 15$ inches size.

* * * * *